United States Patent [19]

Dorfeld

[11] 4,079,349

[45] Mar. 14, 1978

[54] LOW TCR RESISTOR

[75] Inventor: William G. Dorfeld, Corning, N.Y.

[73] Assignee: Corning Glass Works, Corning, N.Y.

[21] Appl. No.: 727,893

[22] Filed: Sep. 29, 1976

[51] Int. Cl.[2] ..... H01C 7/06

[52] U.S. Cl. ..... 338/9; 29/610 R; 338/7; 338/307; 338/308; 338/309; 338/328

[58] Field of Search ..... 338/7, 8, 9, 10, 306, 338/307, 308, 309, 313, 322, 324, 327, 328, 332, 334; 29/610, 621

[56] References Cited

U.S. PATENT DOCUMENTS

| | | | |
|---|---|---|---|
| 3,881,162 | 4/1975 | Caddock | 338/332 X |
| 3,921,119 | 11/1975 | Caddock | 338/309 X |

*Primary Examiner*—C. L. Albritton

*Attorney, Agent, or Firm*—William J. Simmons, Jr.; Walter S. Zebrowski; Clarence R. Patty, Jr.

[57] ABSTRACT

Disclosed is a resistor comprising a nonconductive substrate on which is disposed a rectangularly-shaped coating of resistive material having a negative TCR. Oppositely disposed along the longer sides of the coating is a pair of elongated, parallel strips of resistive material having a positive TCR. Electrical connection is made to the opposed ends of the coating and to an end of each strip. The strips and electrical connections are so disposed that at low temperatures, current flow is predominantly across a relatively wide, short path in the coating between the strips, and at higher temperatures, current flow is predominantly along a longer, narrower path in the coating which is parallel to the strips.

10 Claims, 5 Drawing Figures

LOW TCR RESISTOR

BACKGROUND OF THE INVENTION

The present invention relates to electrical resistors, and more particularly, to resistor configurations which enable the determination of the temperature coefficient of resistance (TCR) thereof.

It is sometimes desirable to employ a given electroconductive material for use as a resistor or heater because of certain properties that it may possess such as desirable values of resistivity and thermal coefficient of expansion, while the temperature coefficient of resistance of that material may be undesirable for its intended use. For example, the thermal coefficient of expansion, thermal conductivity and resistivity of silicon cause that material to be suitable for deposition on a low expansion glass-ceramic material for use as a heating element. However, the negative TCR of silicon necessitates a current limited power supply to avoid thermal runaway. In lieu of this relatively expensive type of power supply, it would be advantageous to prevent thermal runaway by modifying the TCR of the heating element.

SUMMARY OF THE INVENTION

It is therefore an object of the present invention to provide a resistor construction whereby the desired TCR can be obtained.

Briefly, the resistor of the present invention comprises a sheet of resistive material having a first TCR. Electrically contacting the sheet are first and second spaced, elongated strips or paths of resistive material having a second TCR which is different from the first TCR. The first and second strips are angularly disposed with respect to a pair of conductive strips which are electrically connected thereto. The distance between the elongated strips is less than the distance between the conductive strips.

DETAILED DESCRIPTION

It is to be noted that the drawings are illustrative and symbolic of the invention, and there is no intention to indicate scale or relative proportion of the elements shown therein.

Figure 1:
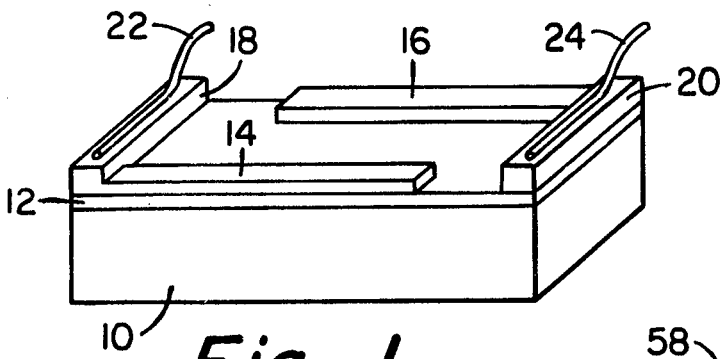
FIG. 1 is an oblique view of a basic form of a resistor constructed in accordance with the present invention.

Referring to FIG. 1, there is shown a dielectric substrate 10 having a first coating 12 of an adherent electrically resistive material disposed on a surface thereof. Substrate 10 may consist of any nonconductive material such as glass, ceramic, glass-ceramic, plastic or the like or a conductive substrate having an insulating layer thereon. Disposed along the longer sides of the surface of coating 12 are two strips 14 and 16 of a second electrically resistive material. Disposed on the surface of layer 12 along the shorter sides thereof is a pair of electrical termination strips or paths 18 and 20 which are electrically connected to strips 14 and 16, respectively.

Lead wires 22 and 24 are soldered or otherwise electrically connected to termination strips 18 and 20, respectively. In FIG. 1 termination strips 18 and 20 are illustrated as consisting of the same material as strips 14 and 16 but being greater in thickness to lower the resistance thereof. If the resistance of strips 18 and 20 is sufficiently low, leads 22 and 24 could be connected to any portion thereof rather than along the entire length of those strips as illustrated in FIG. 1. Alternatively, strips 18 and 20 could consist entirely of highly conductive material. If material 12 can be formed in a self-supporting sheet or block, substrate 10 will be unnecessary.

The TCR of the first applied coating 12 may be positive or negative and must be different from that of resistive strips 14 and 16, and the materials must have TCR values of opposite sign to obtain an effective TCR of substantially zero. However, in some instances, the TCR values of the two materials will be both positive or both negative but different in magnitude. Examples of materials having a negative TCR are carbon, silicon carbide, silicon and the like and examples of materials having a positive TCR are metals and alloys such as nickel-aluminum alloy, nickel-chromium alloy and the like.

Figure 2:
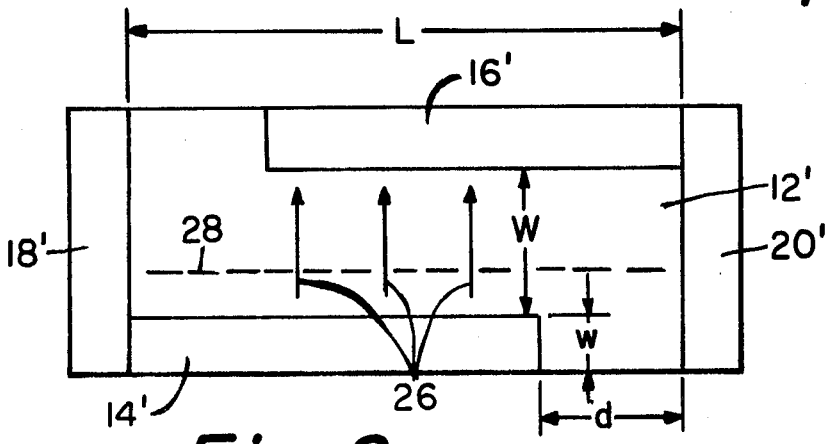
FIG. 2 is a diagram which illustrates the principles of operation of the present invention.

The principles of operation of the present invention will be described in conjunction with the diagram in FIG. 2 wherein elements similar to those of FIG. 1 are represented by primed reference numerals. For purposes of this explanation it will be assumed that the first coating 12 has a negative TCR and strips 14 and 16 have a positive TCR. This diagram illustrates two of the components of current flow through the first coating 12', viz. a transverse component represented by arrows 26 and a longitudinal component represented by dashed line arrow 28. At a first temperature a given amount of current will flow along the paths represented by arrows 26 and 28. If either current flow through the resistor or externally supplied heat increase the temperature of the coating 12' and strips 14' and 16', the resistance of strips 14' and 16' will increase, thereby causing current components 26 to decrease. Since the major component of current flow shifts from the relatively short and wide path between strips 14' and 16' to a longer and narrower path between termination strips 18' and 20', the resistance of the overall resistor would tend to increase except for the fact that the negative TCR of the coating 12' causes the resistance of that coating to decrease, thereby increasing current component 28. By properly selecting the materials for the coating 12 and the strips 14 and 16 as well as the dimensions of these elements, an overall TCR near zero can be achieved.

Applications of this resistor are not restricted to full compensation as described above. Resistive heating elements can be made by this method such that the resistance shows a minimum at the desired operating temperature. The natural power limiting capability of such a heating element advantageously limits the maximum temperature thereof.

An additional advantage of resistors constructed in accordance with the present invention is their ability to dissipate hot spots in resistive material having a negative TCR. When a hot spot develops in such material, the resistivity decreases, thereby resulting in a greater current flow through the hot spot. If the resistive strips are separated by a sufficiently small spacing, depending upon the thermal conductivity of the material having a negative TCR, the heat from the hot spot will be conducted to the adjacent elongated strips of positive TCR material. As the positive TCR material becomes heated, its resistivity increases, decreasing the current flowing to the hot spot, thereby resulting in its dissipation.

Figure 3:
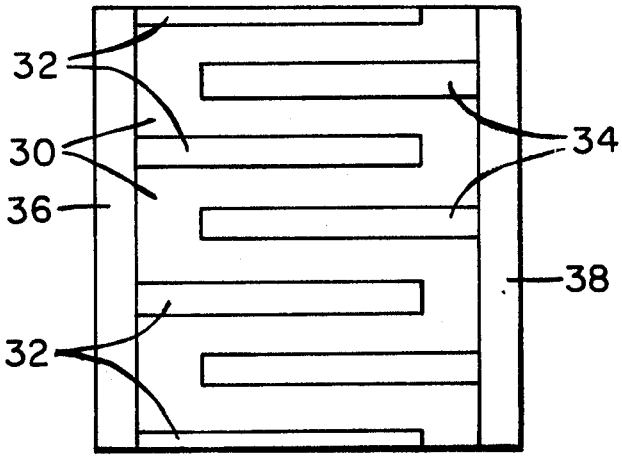

As illustrated in FIG. 3, the pattern of resistive material can be extended to form an array of interleaved, multiply connected strips 32 and 34 which are disposed on the surface of a first applied coating of resistive material. In this embodiment conductive terminal strips 36 and 38 are employed to make electrical connection to resistive strips 32 and 34, respectively.

Figure 4:
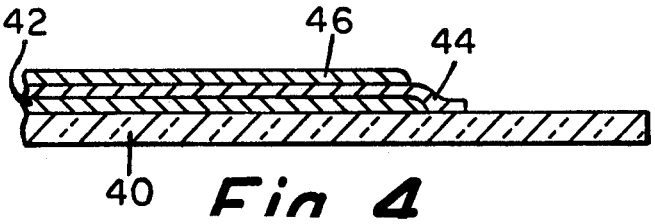
FIG. 4 is a cross-sectional view illustrating one form of construction of a resistor formed in accordance with the present invention.

The cross-sectional view of FIG. 4 illustrates that another coating of the first applied electrically resistive material may be disposed on top of the first two applied coatings. In this embodiment, a first coating 42 of a first resistive material is disposed on substrate 40. Coating 44 of a second resistive material is patterned in the manner illustrated in FIG. 3, for example, and a second coating 46 of the first material is disposed over patterned coating 44 and the exposed portions of coating 42. Alternatively, interconnected wires of the second material can be placed on coating 42, and coating 46 can be deposited thereover to secure the wires to the substrate. The first coating 42 may be omitted if desired, the coating 44 or wire matrix being disposed directly on substrate 40.

Figure 5:
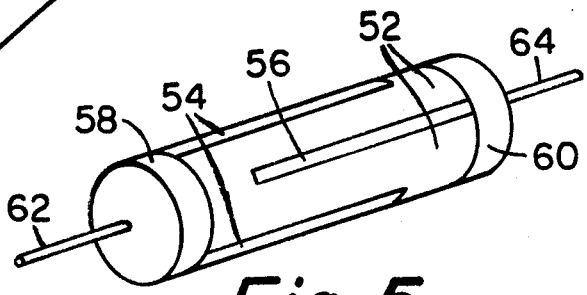
FIGS. 3 and 5 illustrate further embodiments of this invention.

FIG. 5 illustrates that resistors formed in accordance with the present invention may be disposed on curved substrates as well as the previously described flat substrates. After a first coating 52 of a first electrically resistive material is deposited on the surface of a cylindrical substrate, patterned coatings 54 and 56 of a second material are so disposed on the first coating that strips 54 are interleaved with strips 56. Conductive endcaps 58 and 60 connect conductive leads 62 and 64 with resistive strips 54 and 52, respectively.

A resistor of the type illustrated in FIG. 1 is constructed as follows. Since the resistor is to be employed at high temperatures, a low expansion glass ceramic material is chosen for the substrate, and silicon is selected for the resistive coating 12. A nickel-chromium alloy (80% Ni — 20% Cr), which has a positive TCR, is selected for the resistive strips 14 and 16 since the silicon coating has a TCR of −0.007 per degree C. In addition, a thin layer of platinum is fired onto the nickel-chromium strips to increase the TCR thereof.

The following method is employed to obtain a general indication of the dimensions of the resistor elements. The resistor should have a substantially constant resistance between room temperature and 450° C. At room temperature the resistance along strips 14 and 16 should be much less than the resistance across coating 12 in the direction of arrows 26 of FIG. 2. Due to the fact that the device is elongated in the manner illustrated, the resistance along path 28 is obviously greater than the resistance along paths 26. To prevent hot spots from developing in those portions of coating 12 between the end of resistive strip 14 and termination strip 20 and between the end of resistive strip 16 and termination strip 18, the distance d of FIG. 2 should be equal to or greater than the separation W between resistive strips. At 450° C. the resistance of coating 12 between strips 18 and 20 should be much less than the resistance along resistive strips 14 and 16.

These design criteria are satisfied by a resistor constructed as follows. A low-expansion glass-ceramic substrate having a surface the dimensions of which are 2 cm by 4 cm is provided with a 0.03 cm thick coating of flame sprayed silicon. Resistive strips 14 and 16 are formed by vacuum evaporating through a metal mask an alloy of 80% nickel — 20% chromium. These strips are L-shaped as shown in FIG. 1 and have a width of about 0.4 cm and a thickness of about 0.5 μm. The L-shaped resistive strips are alloyed with platinum by brushing thereon an organo-platinum compound known as Engelhard-Hanovia liquid organic platinum No. 7450 The device so coated is then fired at 900° C for about 15 minutes. The thickness of termination strips 18 and 20 is increased by extra brushing with organo-metallic platinum paste to increase the conductivity thereof. The overall resistance of the element is about 120 ohms and varies less than 1% over the temperature range between 20° C and 450° C, indicative of a TCR of less than $2 \times 10^{-5}$ per degree C.

The low voltage multi-element heater of the type illustrated in FIG. 3 is constructed as follows. A coating of silicon metal approximately 0.5 mm in thickness is plasma jet sprayed onto a low-expansion glass-ceramic substrate 12 cm by 12 cm by 0.5 cm. The resistivity of the silicon is approximately 5 ohm-cm. A pattern of interleaved strips of silver metal 32 and 34 is vacuum evaporated through a mask onto the silicon. The width of the strips is 0.75 cm, except for the strips at either end of the substrate which are 0.37 cm in width. The length of these strips is 9 cm. The thickness of the strips is then increased by brushing thereon a paste of silver metal particles in an organic binder until the overall device resistance is between 3 and 4 ohms.

When operated at temperatures around 600° C, this device is found to have a slightly negative TCR and operates at high temperatures in a stable manner.

I claim:

1. An electrical device comprising a sheet of a first resistive material having a first temperature coefficient of resistance, first and second spaced conductive terminals disposed on said sheet, at least one elongated strip of resistive material connected to said first conductive terminal and being angularly disposed therewith, and at least another elongated strip of resistive material connected to said second conductive terminal and being angularly disposed therewith, the temperature coefficients of resistance of said elongated strips being different from that of said sheet, the distance between said elongated strips being less than the distance between said conductive terminals.

2. An electrical device in accordance with claim 1 further comprising a dielectric substrate, said sheet of first electroconductive material comprising an adherent coating on said substrate.

3. An electrical device in accordance with claim 2 wherein said first and second terminals are orthogonally disposed with respect to said elongated strips.

4. An electrical device in accordance with claim 3 further comprising means for making an electrical connection to each of said first and second terminals.

5. An electrical device in accordance with claim 2 wherein said first and second terminals comprise spaced parallel conductive strips, said at least one elongated strip and said at least another elongated strip each comprising a plurality of elongated resistive strips extending from their respective conductive strips, the resistive strips extending from said first terminal being interleaved with the resistive strips extending from said second terminal.

6. An electrical device in accordance with claim 5 wherein the thermal coefficients of resistance of said first resistive material and that of said elongated strips of resistive material are opposite in sign.

7. An electrical device in accordance with claim 6 further comprising means for making an electrical connection to each of said parallel conductive strips.

8. An electrical device in accordance with claim 2 wherein said substrate has a curved surface.

9. An electrical device in accordance with claim 2 wherein the thermal coefficients of resistance of said first resistive material and that of said elongated strips of resistive material are opposite in sign.

10. An electrical device in accordance with claim 9 wherein said first resistive material is silicon and said elongated strips of resistive material have a positive temperature coefficient of resistance.

* * * * *